US009828210B2

(12) United States Patent
Celik et al.

(10) Patent No.: US 9,828,210 B2
(45) Date of Patent: Nov. 28, 2017

(54) INVERTER PARAMETER BASED HYDRAULIC SYSTEM CONTROL DEVICE

(71) Applicant: YASKAWA EUROPE GMBH, Eschborn (DE)

(72) Inventors: Kutay Ferhat Celik, Oedheim (DE); Philipp Kenneweg, Frankfurt am Main (DE)

(73) Assignee: Yaskawa Europe GmbH, Eschborn (DE)

( * ) Notice: Subject to any disclaimer, the term of this patent is extended or adjusted under 35 U.S.C. 154(b) by 499 days.

(21) Appl. No.: 14/380,365

(22) PCT Filed: Jan. 23, 2013

(86) PCT No.: PCT/EP2013/051207
§ 371 (c)(1),
(2) Date: Aug. 21, 2014

(87) PCT Pub. No.: WO2013/124109
PCT Pub. Date: Aug. 29, 2013

(65) Prior Publication Data

US 2015/0014099 A1 Jan. 15, 2015

(30) Foreign Application Priority Data

Feb. 21, 2012 (EP) ..... 12156319

(51) Int. Cl.
*B66B 1/28* (2006.01)
*B66B 1/30* (2006.01)
(Continued)

(52) U.S. Cl.
CPC ..... *B66B 1/30* (2013.01); *B66B 1/24* (2013.01); *B66B 1/405* (2013.01); *B66B 9/00* (2013.01); *B66B 11/0423* (2013.01); *F04B 35/04* (2013.01)

(58) Field of Classification Search
CPC .. B66B 1/30; B66B 1/24; B66B 1/405; B66B 9/00; B66B 11/0423; F04B 35/04
(Continued)

(56) References Cited

U.S. PATENT DOCUMENTS 3,530,958 A 9/1970 Brannon et al.
4,593,792 A 6/1986 Yamamoto
(Continued)

FOREIGN PATENT DOCUMENTS

| | | |
|---|---|---|
| EP | 1721856 A1 | 11/2006 |
| JP | 03-098965 | 4/1991 |
| JP | 06-115835 | 4/1994 |
| JP | 2001-19291 A | 8/2002 |
| WO | 2010/125525 A1 | 11/2010 |

OTHER PUBLICATIONS

Prosecution Document, Extended European Search Report dated Jul. 24, 2012 for Application No. 12156319.1, 5 pages.
(Continued)

*Primary Examiner* — Anthony Salata
(74) *Attorney, Agent, or Firm* — Dorsey & Whitney LLP

(57) ABSTRACT

The present invention relates to a control device for pressure control in a hydraulic system, especially of an elevator-system, the control device is adapted to control an output variable of an inverter supplying a hydraulic pump of the hydraulic system with electric energy, the output variable is adapted to adjust the speed of the hydraulic pump in order to at least partly compensate for a leakage of operating fluid in the hydraulic pump. Further, the invention relates to an elevator-system that includes a hydraulic pump, an inverter, and a control device which controls a supply of the hydraulic pump with electric energy from the inverter. Moreover, the invention relates to a method for pressure control in a hydraulic system, especially of an elevator-system, the method that includes the steps of supplying a hydraulic pump of the hydraulic system with electric energy from an
(Continued)

inverter, controlling at least one output variable of the inverter for adjusting the speed of the hydraulic pump, in order to at least partly compensate for a leakage of operating fluid in the hydraulic pump. For providing an inexpensive elevating solution with good right quality for hydraulic elevators, the present invention provides that the control device includes a computing module which is adapted to determine the output variable based on at least one inverter parameter.

19 Claims, 7 Drawing Sheets

(51) Int. Cl.

| | |
|---|---|
| ***B66B 1/24*** | (2006.01) |
| ***B66B 1/40*** | (2006.01) |
| ***B66B 9/00*** | (2006.01) |
| ***B66B 11/04*** | (2006.01) |
| ***F04B 35/04*** | (2006.01) |

(58) Field of Classification Search
USPC ..... 187/247, 285, 286, 289, 293, 295, 296, 187/391–393; 318/66, 799–815; 417/18–21, 31, 38, 41, 42, 44.1, 44.2
See application file for complete search history.

(56) References Cited

U.S. PATENT DOCUMENTS

| | | | | |
|---|---|---|---|---|
| 5,131,507 | A * | 7/1992 | Watanabe | B66B 1/30 187/285 |
| 5,155,305 | A | 10/1992 | Horbruegger et al. | |
| 5,243,154 | A * | 9/1993 | Tomisawa | B66B 1/24 187/286 |
| 5,522,479 | A * | 6/1996 | Jo | B66B 1/24 187/275 |
| 5,635,689 | A | 6/1997 | Shepard et al. | |
| 6,142,259 | A | 11/2000 | Veletovac et al. | |
| 6,971,481 | B2 * | 12/2005 | Moser | B66B 9/04 187/275 |
| 7,134,528 | B2 * | 11/2006 | Birbaumer | B66B 1/24 187/275 |
| 8,997,939 | B2 * | 4/2015 | Acquaviva | B66B 1/24 187/285 |

OTHER PUBLICATIONS

Prosecution Document, PCT International Search Report, dated Feb. 27, 2013 for PCT/EP2013/051207, 2 pages.
Japanese Office Action for related Japanese Patent Application No. 2014-556969, dated Aug. 4, 2015 (4 pages).
Japanese Patent Office, The First Notice of Review Opinions for Japanese application No. 2013800100643, dated Apr. 3, 2015, 16 pages.

* cited by examiner

INVERTER PARAMETER BASED HYDRAULIC SYSTEM CONTROL DEVICE

CROSS-REFERENCE TO RELATED APPLICATIONS

This application is the national stage application of International patent application No. PCT/EP2013/051207, entitled "Device and Method for Controlling a Hydraulic System, Especially of an Elevator," and filed on Jan. 23, 2013, which claims priority to European application No. 12156319.1, entitled "Connected Disk Binding Mechanism" and filed on Feb. 21, 2012, which are hereby incorporated by reference herein in their entireties.

TECHNICAL FIELD

The present invention relates to a control device for pressure control in a hydraulic system, especially of an elevator-system.

BACKGROUND

Control devices, elevator-systems, comprising control devices and methods for pressure control in hydraulic systems, as mentioned above, are known from the prior art. In a hydraulic elevator system, a motor is usually coupled to a screw-pump which produces an oil flow and pressure that is supplied to a cylinder through a control valve. As the ram (piston) moves, it pushes or pulls the car (cabin).

In order to have good ride-quality; smooth start, accurate acceleration and deceleration, as well as smooth stop are important properties to satisfy. Full and levelling (small) speeds are preferably kept unchanged regardless of the changes of elevator load and/or oil temperature. It is important to keep the elevator speeds (full and levelling) constant otherwise the complete travel time becomes longer, which causes uncomfortable ride-quality, poor stopping accuracy (bigger than ±10 mm), affects the traffic cycle and increases the energy consumption of the elevator. Unfortunately, elevator load and fluid temperature influence the leakage of the pump drastically which varies the speed and the total travel time of the hydraulic elevator.

Hydraulic elevator solutions according to the prior art that assure expected ride-quality by means of inverters are too costly and complicated to meet market expectations. They require not only a special control valve but also load and/or flow sensors, mostly closed loop control (requires expensive submersible encoder and necessary electronic interface), costly electronic boards and trained service personnel. Additionally, to increase speed compensation accuracy and avoid noise problems mostly low-leakage, less-noisy screw pumps are employed at the cost of increased initial costs of the system.

Moreover, in the last ten years, energy efficiency has become an important product specification. Especially in the European Union, directives and standards are being modified to cover up the energy efficiency criteria on all products, including elevators. According to a new building code, energy efficient building equipment is enforced. Hence, it is expected that soon energy efficient elevators will be made compulsory for buildings in order to obtain green-building certification, which exempts building owners from paying taxation.

Consequently, a large number of renovations of hydraulic elevators are expected to take place in the coming years. Additionally, invasion of high life standards into developing countries and the rest of the world gave rise to the standards of the European Union being targeted by many non-European countries. Therefore, a majority of new elevator installations is expected to have high energy efficient properties.

Today, the use of inverters for powering hydraulic pumps is regarded as the ultimate energy efficient solution for elevator-systems. However, solutions with inverters have been either too primitive to assure expected standards or too expensive and complicated to meet market expectations. Thus, hydraulic solutions with inverters for powering hydraulic pumps could not find a vast acceptance in the market, even though a demand for energy saving elevator technology is increasing as already mentioned.

SUMMARY

In view of the above, an object underlying the present invention is to provide an inexpensive, energy efficient elevating solution with good ride quality for hydraulic elevators.

This object is achieved according to the present invention for the control device mentioned in the beginning of the description, in that the control device comprises a computing module which is adapted to determine the output variable based on at least one inverter parameter.

Further, the present invention relates to an elevator-system comprising a hydraulic pump, an inverter, and a control device which controls a supply of the hydraulic pump with electric energy from the inverter.

Moreover, the present invention relates to a method for pressure control in a hydraulic system, especially of an elevator, the method comprising the steps of supplying a hydraulic pump of the hydraulic system with electric energy from an inverter, controlling at least one output variable of the inverter for adjusting the speed of the hydraulic pump, in order to at least partly compensate for a leakage of operating fluid in the hydraulic pump.

The present invention relates to a control device for pressure control in a hydraulic system, especially of an elevator-system, the control device is adapted to control an output variable of an inverter supplying a hydraulic pump of the hydraulic system with electric energy, the output variable is adapted to adjust the speed of the hydraulic pump in order to at least partly compensate for a leakage of operating fluid in the hydraulic pump.

For the elevator-system mentioned in the beginning of the description, the object is achieved in that the elevator-system comprises a control device according to the present invention.

For the method mentioned in the beginning of the description, the object is achieved in that the at least one output variable is determined as a function of at least one inverter parameter.

The solution allows for a compensation of leakage and pressure loss not only in the hydraulic pump, but in the entire hydraulic system by adjusting the speed of the hydraulic pump without directly measuring motor load or system pressure. The output variable may be computed solely on the basis of the at least one inverter parameter. Hence, complicated and costly sensors as well as means for motor load or system pressure measurements may be omitted. The solution according to the present invention therefore allows for providing an inexpensive elevator system with good ride quality in hydraulic elevators powered by means of an inverter. By compensation and correction of output variables according to the present invention, the speed of the car may under any load and/or temperature of the hydraulic fluid match reference speeds with an accuracy of better than 5%, 2% or even to 1% depending on the accuracy of any inverter variables, reference values, speeds and/or variables obtained during teaching and probe runs of the car.

Moreover, the solution according to the present invention, allows for a simplification of the hydraulic system in that an interface with a control valve for controlling the pressure exerted onto the elevator piston may be omitted. The solution is inexpensive and can be easily applied to all existing hydraulic elevator power units, basically by adding the inverter to the existing system. Accurate corrections of elevator speed (motor speed) due to the variation of the load to be lifted and to the oil temperature may be computed by specialised inverter software within the control device, i.e. the computing module according to the present invention.

In the following, further improvements of the control device, the elevator-system and the method according to the invention are described. These additional improvements may be combined independently of each other, depending on whether a particular advantage of a particular improvement is needed in a specific application.

According to a first advantageous improvement of the control device, the at least one inverter parameter may comprise at least one of an output current, torque producing current, and internal torque reference value. Monitoring the output current, the torque producing current and/or an internal torque reference value as the at least one inverter parameter for computing the output variable is an easy to realise and reliable way for determining the load condition in the car and for compensating any leakage within the motor and/or pressure loss within the entire hydraulic system by adjusting the motor speed and thereby the speed and power of the hydraulic pump.

The control device may comprise a monitoring module which is connected to a comparator module, and during operation of the control device, the monitoring module may monitor the at least on inverter parameter and the comparator module may compare the at least one monitored inverter parameter to at least one reference parameter. The reference parameter may be entered during an initial setting of the inverter. Thereby, the control device may be easily adjusted to the specifications of the hydraulic system e.g. by entering hydraulic pump and fluid data. The output current, torque producing current, internal torque reference, etc. are carload dependent parameters. In the beginning of every travel of the car, variations of at least one of these parameters may be monitored and compared to the at least one reference parameter. The at least one reference parameter may be pre-set during the initial setting, to determine the actual carload condition. The computing module may then accurately calculate a corresponding required motor speed and deceleration time (when necessary) under the actual carload in order to obtain required flow rates of the hydraulic pump.

The at least one reference parameter may comprise at least one other reference frequency and a reference gain. For obtaining the at least one inverter parameter, the elevator may be run at least one or a couple of times while measuring the at least one reference parameter and monitoring a correlating elevator speed. Optionally, the car may be run either at a constant speed mode, where the elevator speed is kept constant, or at an energy saving speed mode, where the speed of the car is lowered according to the load in the car. The energy saving speed mode (Maximum Speed Mode) may allow lower motor sizes to be employed and may guarantee preset travel time by recalculating a deceleration time as the speed of the elevator is changed.

For easily providing data to the control device, the control device may comprise a memory module adapted to store and access at least one of a motor data, a pump data, a valve data and a hydraulic fluid data. For example, the memory module may comprise a digital/electronic memory unit, within which the motor data, the pump data, the valve data and/or the hydraulic fluid data may be stored and accessed.

In operation, any output variable of the control device may be adapted to effect a positive pump pressure corresponding to a positive flow rate of the pump. For example, positive pump pressure and/or flow rate of the pump may be generated during both up- and down-travels of the car in the elevator system. An upward pump flow rate may be generated to control the speed of the car during down travels in order to provide good ride quality. Thereby, a sensorless load compensation may be applied to down-direction travels of the car or at least a pressure sensor may be omitted. The down travel ride-quality may be supported by running the inverter in an up-direction to soften down direction travel by load compensation. In other words, a positive pump flow rate may be obtained which is just sufficient to compensate for the pressure due to a respective load of the car and/or a pressure drop or loss inherent in the system and/or the elevator system. This helps in omitting complicated control valves and promotes the usability of more simple valves and thereby the cost-efficiency of a hydraulic system equipped with a control device according to the present invention.

For starting and stopping a car in an elevator-system, the output variable may be adapted to cause the hydraulic pump to run with a leakage speed which is a speed where hydraulic pressures drops due to a pump leakage and/or a pressure drop inherent in the hydraulic system is essentially equaled out. In other words, a positive pump flow rate may be generated which is just sufficient to compensate for the respective applied pressure corresponding to the load of the car and/or a pressure drop inherent in the hydraulic system. Thereby, a smoother start and stop of the elevator may be assured (under current load and oil temperature conditions) during start and stop of the elevator. This functionality may be part of additional procedures implemented in the computing module in order to assure higher accuracy, shorter take-off time, higher safety levels and good ride-quality.

The control device may further have at least one measurement input for connecting a temperature sensor to the control device, in order to use at least one temperature sensor in determining the at least one output variable. Thereby, an inexpensive temperature sensor may be used in connection with the control device in order to allow speed compensation due to a variation of fluid temperature and to obtain an accurate load compensation by recalculating fluid resistance and the actual fluid temperature.

For easy installation and retrofit into new and/or existing hydraulic systems, during operation, the hydraulic pump may be controlled by open loop control and/or V/f control.

A control device according to the present invention may further help in simplifying a hydraulic system in that the control device may be integrated into the inverter. In other words, the control device and components of the inverter, such as an input power converter and/or an output power converter and controlling units of the control device, such as the computing module, the memory module, the monitoring module and/or the comparator module may be arranged as an electronic assembly and may be commonly integrated into a box or housing. Hence, the inverter and the control device may come as one piece which may be easily installed and/or retrofitted.

An inventive method mentioned in the beginning of the description may be further improved in that the at least one inverter parameter may be monitored and compared to at least one reference parameter. The at least one reference parameter may be obtained during at least one test run. Thereby, the inventive method may be applied to any hydraulic system by adapting the inverted parameter to the reference parameter.

In order to provide good ride quality and energy-efficiency throughout the ride, a leakage of the hydraulic pump and/or a pressure loss in the hydraulic system according to a respective load of at least one car of the elevator-system and/or a respective temperature of the hydraulic fluid in the hydraulic system is at least partly compensated for during a full speed and/or a levelling speed of the car.

Essentially constant levelling durations and an increase in ride quality may be achieved in that the length of a deceleration phase of the speed of the hydraulic pump can be adjusted in order to keep the length of a levelling phase, where the hydraulic pump runs at a levelling speed, essentially constant under at least two different inverter parameters.

A positive flow rate and/or pressure may be generated by the hydraulic pump in order to compensate for a speed of the car in the elevator system during a travel of the car in the downward direction. In other words, during travel of the car in a the downward direction, the pump may generate a positive flow rate, i.e. a flow rate running in the same direction as during upward travel, which helps in omitting complicated and hence expensive hydraulic valves.

Moreover, a kit, e.g. a retrofit kit may comprise an inventive control device. Also, an inverter equipped with an inventive control device or having a computing module and further periphery integrated therein may be used as a control device in a hydraulic system by itself.

Further, the invention may relate to a machine readable medium for performing a method according to the present invention. Thereby, a control device may be enabled to perform an inventive method in that the inventive method steps are made available to any control device which may then perform the inventive method step based on data contained on a machine readable medium according to the present invention.

In the following, the invention and its improvements are described in greater detail using exemplary embodiments thereof and with reference to the accompanying drawings. As described above, the various features shown in the embodiments may be used independently of each other according to the respective requirements of specific applications.

DETAILED DESCRIPTION

Figure 1:
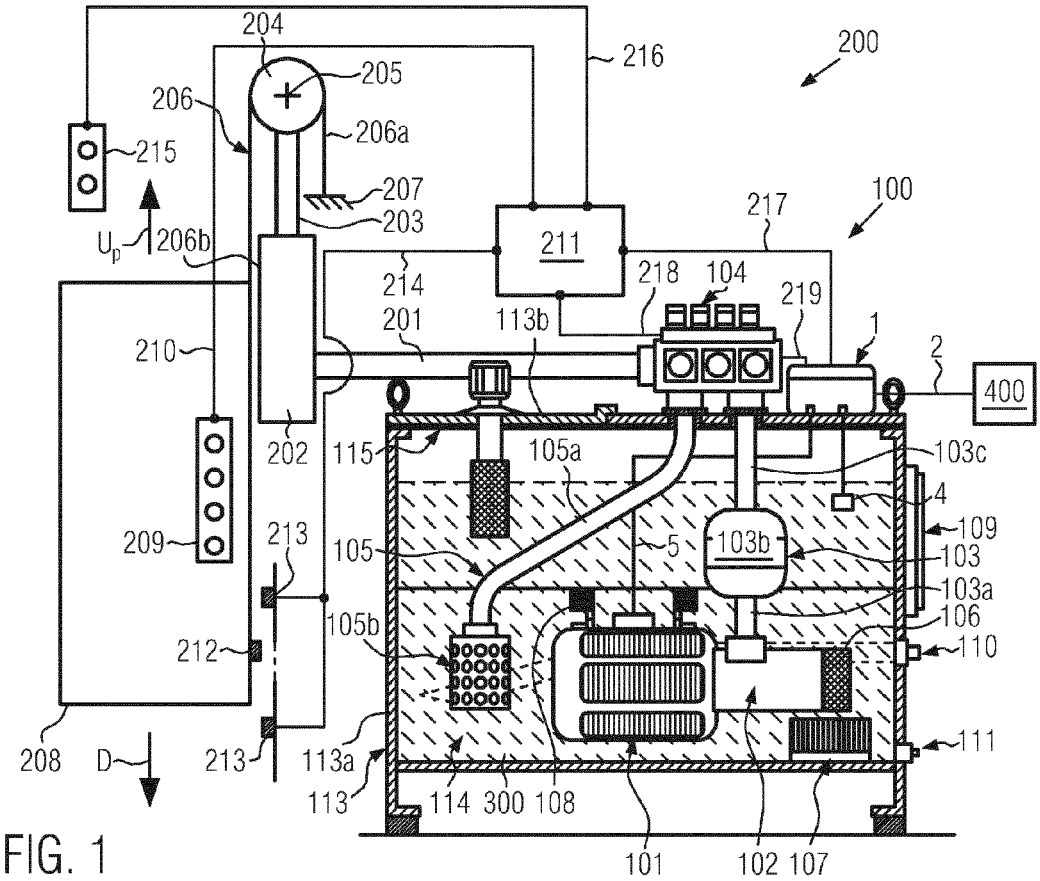
FIG. 1 shows a schematic illustration of a hydraulic system in the form of an elevator system, comprising a control device according to an embodiment of the present invention.

FIG. 1 shows an elevator system 200 comprising a hydraulic system 100 and a control device 1 according to an embodiment of the present invention as a schematic illustration. The elevator system 200 and the hydraulic system 100 may be filled with a hydraulic fluid 300. The hydraulic system 100 and/or the elevator system 200 may be connected to an (electric) energy source 400.

The hydraulic system 100 comprises an electric motor 101 which may be an induction motor, such as an asynchronous AC-motor. The motor 101 is mechanically coupled to a hydraulic pump 102 which may be a low pulsating screw pump. The pump 102 is connected to a duct 103 which comprises a first duct portion 103*a*, a silencer/pulsation damper 103*b*, as well as a second duct portion 103*c* and leads to a hydraulic valve 104. From the valve 104, a duct 201 leads to an elevating cylinder 202 of the elevator system 200, the components of which will be discussed further down below. A duct 105 comprising a first duct portion 105*a* and a diffuser 105*b* leads back from the valve 104.

Further, the hydraulic system 100 comprises a strainer 106 at an inlet of the hydraulic pump 102. Below the strainer 106, a heater 107 is arranged for heating the hydraulic fluid 300. The motor 101 and the pump 102 are supported by damping elements which may be rubber dampers. Moreover, the hydraulic system 100 is provided with a level indicator 109, a cooler plug 110, a drain plug 111, a breather cap 112 and a housing 113. The housing 113 comprises a reservoir portion 113*a* as well as a lid portion 113*b*. The housing 113 provides an interior space 114. In order to seal up the interior space 114, a sealing element i.e. a gasket 115 is arranged between the reservoir portion 113*a* and the lid portion 113*b*. The hydraulic fluid 300, such as [[a]] hydraulic oil, is received in the housing 113.

The elevator system 200 further comprises a piston rod 203 moveably received in the cylinder 202. The piston rod 203 may carry at its top end a sheave 204. The sheave 204 is rotatably mounted on a horizontal axis 205. A cable 206 passes around the sheave 204. A first section 206*a* of the cable may be connected, i.e. grounded at a stationary point 207. A second section 206*b* of the cable 206 is connected to a car 208 of the elevator system. The car 208 may be guided in a shaft (not shown). Within the shaft, the car 208 is moveable in an upward direction Up and in a downward direction D.

The car 208 may be provided on its inside and/or on its outside with a control panel 209. Via a control line 210, the control panel 209 may be connected to a main control device 211 of the elevator system 200. The car 208 is further provided with a positioning element 212. The positioning element 212 is adapted to interact with counter-positioning elements 213 arranged within the shaft along a travel-way of the car. The counter-positioning elements 213 may be connected to the main control device 211 via a control line 214. A further control panel 215 may be provided and connected to the main control device 211 via a control line 216.

The main control device 211 is connected to the control device 1 via a control line 217. The control device 1 may be connected to the energy source 400 via a power line 2. Via a measuring line 3, the control device 1 may be connected to a temperature sensor 4. As a temperature sensor which may be connected to a signal conditioner, a PT100(RTD) thermo-couple may be used. The signal conditioner may have an output range of 0 to 10 V corresponding to a temperature range of the sensor 4 from 0 to 100 C. The signal conditioner may be connected to an analog signal input of the control device 1, e.g. of the monitoring module 8. Via an electrical line 5, the control device 1 may be connected to the motor 101. A further control line 218 is provided between the main control device 211 and the hydraulic valve 104 for controlling the actuation of the hydraulic valve 104. The actuation of the hydraulic valve 104 is further controlled via an additional control line 219 between the control device 1 and the hydraulic valve 104.

Figure 2:
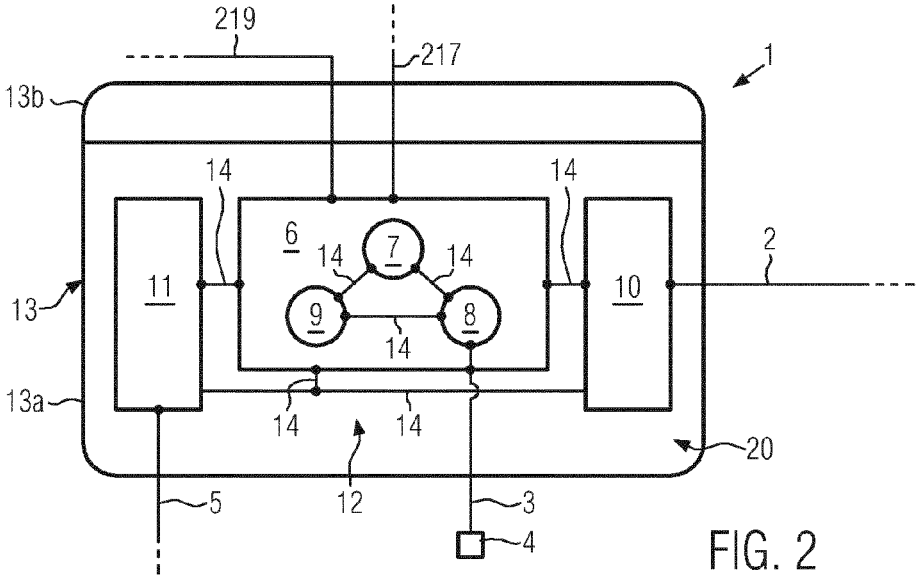
FIG. 2 shows a schematic illustration of a control device according to an embodiment of the present invention.

FIG. 2 shows a schematic overview of the components of the control device 1. The control device 1 may comprise a computing module 6. The computing module 6 may comprise or be connected to a memory module 7, a monitoring module 8, and a comparator module 9. Further, the control device 1 may be provided with an input power converter 10 and an output power converter 11. The computing module 6, the memory module 7, the monitoring module 8, the comparator module 9, the input convertor 10 and the output convertor 11 may be enclosed within an interior space 12 of the control device 1. The interior space 12 may be formed by a box 13 which may have an enclosure portion 13*a* and a lid portion 13*b*. The computing module 6, the memory module 7, the monitoring module 8, the comparator module 9, the input power convertor 10 and the output power convertor 11 may be connected to each other via electrical lines 14 which may transfer electrical power and/or may transmit electronic information as well as information transmitted via a light, i.e. via optical couplers.

The control line 217 and the additional control line 219 may be directly connected to the computing module 6. The power line 2 may be directly to the input power convertor 10. The measuring line 3 may be directly connected to the computing module 6 and/or the monitoring module 8. The supply line 5 may be directly connected to the output power convertor 11. The input power converter 10 and the output power converter 11 may each comprise further control elements and may together form an inverter 20. As inverter 20, e.g. inverter models Yaskawa A1000 or V1000 with OLV control may be employed.

In operation, a request signal for moving the car 208 in the upward direction Up or downward direction D is generated at the control panel 209 or the further control panel 215. Via the control lines 210 and 216, respectively, the request signal is transferred to the main control device 211. The main control device 211 communicates to the control device 1 via the control line 217, that the car is to be moved in the upward direction Up or in the downward direction D according to the corresponding initial request signal for travelling a certain number of levels, i.e. storeys or a certain difference in altitude. Additionally, the main control device 211 and the control device 1 operate and/or monitor the hydraulic valve 104 via the further control line 218 and the additional control line 219, respectively. However, up to this point, a person skilled in the art should recognise that there are many ways in defining and realising a simple request for moving the car upwardly or downwardly, e.g. by a certain binary or other predefined electronic code.

As the control device 1 receives the request from the main control device 211, the computing module 6 of the control device 1 calculates a time line for an upward variable of the inverter powering the electric motor 101, i.e. of the output power convertor 11. The output variable is for example the frequency f, current I and/or voltage U supplied to the electrical motor 101 via the supply line 5. In calculating the output variable f, I, U the computing module 6 will take into account a captured torque $T_x$ of the electrical motor 101, which correlates with the load of the car 208.

Further, the computing module 6 will take into account a captured temperature $Temp_x$. The captured torque $T_x$ influences the pressure in the elevator system 200 and therefore in the hydraulic system 100. The captured temperature $Temp_x$ influences the viscosity of the hydraulic fluid 300. Therefore, the captured torque $T_x$ and the captured temperature $Temp_x$ directly influence leakage from the hydraulic pump 102 as well as an overall pressure drop in the entire elevator system 200 including the hydraulic system 100.

According to the calculated output variable f, I, U, the electrical motor 1 will be supplied with electric power and will drive at a certain speed S [Hz] which will change along a timeline in order to effect a travel of the car 208 according to the initial request computed by the main control device 211. As the pump 102, e.g. in particular at least one screw (not shown) of the pump 102 may be rotationally connected to the electrical motor 101 directly, a rotary frequency of the pump 102 may be regarded as corresponding to the rotational frequency, i.e. speed of the electric motor 101.

For a travel of the car 208 in the upward direction Up, a positive pressure will be generated by the pump 102, such that hydraulic fluid 300 is sucked in from the interior space 114 of the housing 113 through the strainer 106 and then conveyed through the duct 103. From the duct 103, the hydraulic fluid 300 passes the valve 104 into the duct 201 by which the hydraulic fluid 300 is led into the cylinder 202. According to the increasing pressure and therefore increasing amount of hydraulic fluid within the cylinder 202, the piston 203 and thereby the sheave 204 is moved upwardly. Thereby, the sheave 204 transfers the upward movement of the piston 203 onto the cable 206. As the first section 206*a* of the cable 206 is fixed at the stationary point 207, it will be elongated thereby. The second portion 206*b* of the cable 206 will be shortened and thereby move the car 208 in the upward direction Up. By the time the positioning element 212 on the car reaches a certain counter positioning 213 at the shaft, a stop request will be transmitted to the main control module 211 via the control line 214 in a manner known per se. The main control module 211 will then signal to the control module 1 via the control line 217, that the travel of the car 208 is fulfilled according to the initial request initiated at the control panel 209 or the further control panel 215, respectively.

Analogously, for a travel in the downward direction D, a request is initiated at the control panel 209 or the further control panel 215, respectively. The main control device 211 will then cause the valve 104 to open, such that the hydraulic fluid 300 may flow out of the cylinder 202 through the duct 201,1, then through the valve 104 into the duct 105, from where it is led back into the interior space 114 of the housing 113 and therefore disposed through the diffuser 105*b*. For assuring a good ride quality during the backflow of the hydraulic fluid 300, the computing device 6 will also calculate certain output variables f, I, U in order to compensate for any leakage and pressure drop in the elevator system 200 and the hydraulic system 100 in order to maintain convenient start, acceleration, travel, deceleration, levelling and stop during the travel of the car 208 in the downward direction D.

Figure 3:
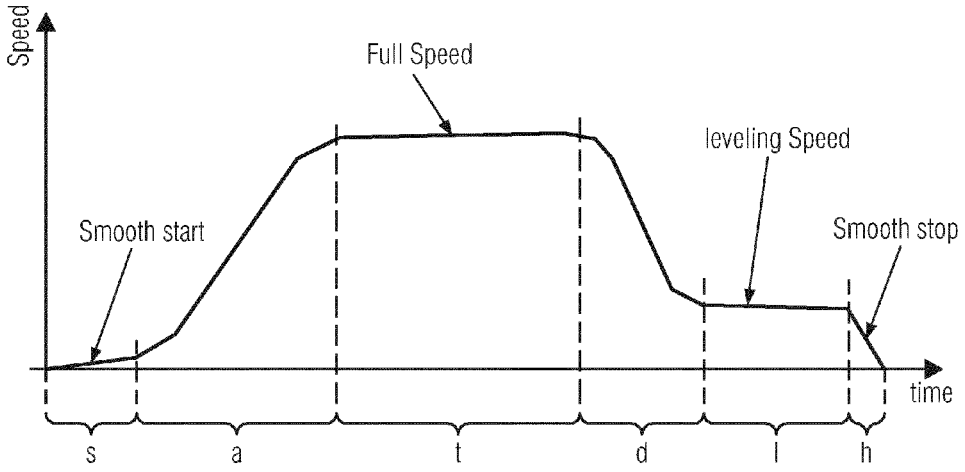
FIG. 3 shows a schematic diagram of the speed of a car in an elevator system as a time graph for good ride quality.

FIG. 3 shows a schematic diagram of the speed of the car which is designed to have a good ride-quality. As the speed of the car is proportional to the pump flow rate, which again is proportional to the motor frequency, the speed of the car shown in FIG. 3 correlates with the pump flow rate and the motor frequency, respectively. From FIG. 1, it can be seen that in a start phase s, a smooth start is desired. The start phase s is followed by an acceleration phase a, wherein the car 208 is further accelerated. After the acceleration phase a, a travel phase t begins, where the car 208 travels at full speed. After the travel phase t, the car is decelerated in a deceleration phase d until reaching a levelling speed in a levelling phase I. In the levelling phase I, the positioning element 212 at the car 208 should be smoothly aligned with one of the counter positioning elements 213 in the shaft. The travel ends after a stop phase h, where the car is smoothly further decelerated until it comes to a full stop. Smooth start, acceleration and deceleration, and smooth stop are important properties for a good ride-quality.

It is expected that full and levelling speeds stay unchanged regardless of changes of a temperature of the hydraulic fluid 300, wherein the pressure is proportional to the load of the car 208, i.e. the elevator load. However, pump flow rates and therefore motor speeds vary, when the load of the car 208 and/or the temperature of the hydraulic fluid changes. It is because pump leakage increases with increasing temperature and pressure.

Figure 4:
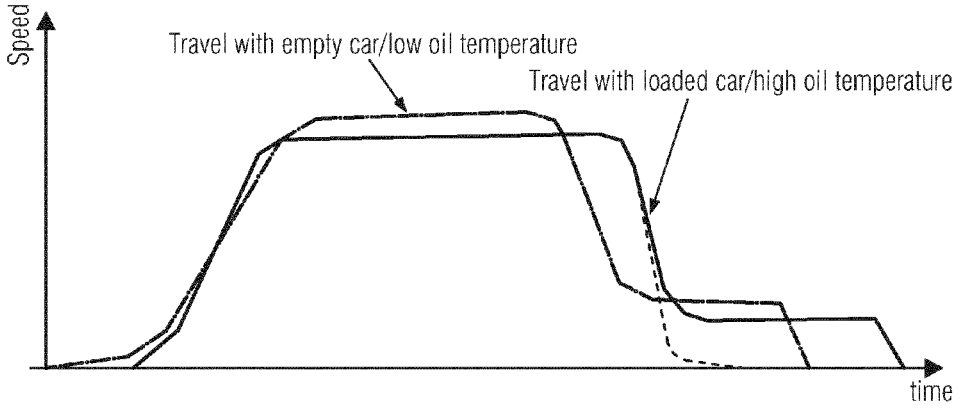
FIG. 4 shows a schematic diagram of the speed of a car in an elevator system in the form of a time graph illustrating ride quality variation on the different carload/fluid temperature conditions.

FIG. 4 shows different diagrams of the speed of the car 208 as the ordinate and the travel time of the car as the abscissa for an empty car 208 and the low temperature of the hydraulic fluid and the dashed and dotted line in comparison with a loaded car and high oil temperature as a solid line. As can be seen, the full speed of the loaded car 208 at high oil temperature is lower than the full speed of the empty car at low oil temperature. Further, acceleration and deceleration take place more rapidly with a loaded car and high oil temperature and the deceleration phase is shifted in time in comparison with an empty car and low oil temperature.

However, it is important to keep the speed of the car 208 constant. Otherwise, the complete travel time becomes longer, which causes uncomfortable ride-quality, poor stopping accuracy (bigger than +/−10 mm) and affects the traffic cycle of the elevator system. In some cases, due to very high temperature and pressure, rotation of the pump at levelling speed may not provide positive flow and the elevator may stand still (zero speed), which is illustrated by the dashed line in FIG. 2. In this event, the elevator would never reach the next upper floor when the electrical motor 101 runs at levelling speed, i.e. the speed intended for reaching levelling speed of the car 208. In order to overcome and avoid these shortcomings and to assure good ride-quality, the present invention provides speed compensation or correction with respect to the temperature of the hydraulic fluid 300 and the load of the car 208. Therefore, the computing module 6 should control the inverter such that full and levelling speed settings (output variables f, I, U) are modified corresponding to the respective torque value of the electric motor 101 and the temperature of the hydraulic fluid 300, which may also change during the travel of the car.

Figure 5:
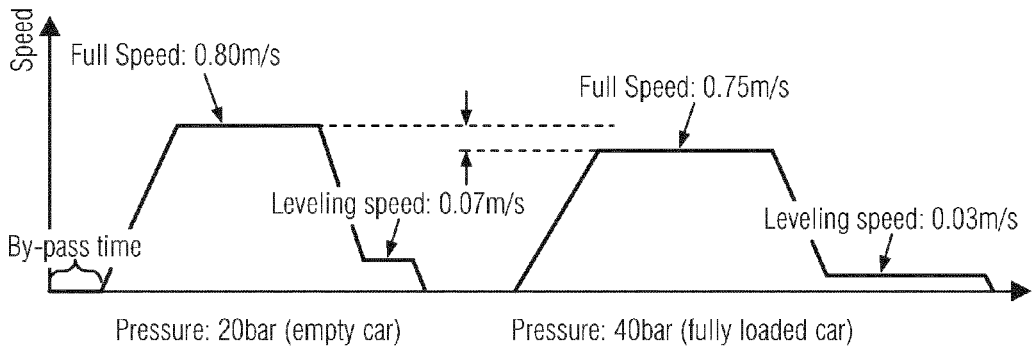
FIG. 5 shows a schematic diagram of the speed of a car in an elevator system illustrating an example of speed variation under empty and loaded car conditions.

FIG. 5 shows two diagrams of the car speed over the time, one with an empty car and one with a fully loaded car. Here, it becomes evident that screw pumps, like the hydraulic pump 102, for example, may have a rather high internal leakage. The amount of leakage changes drastically with increased pressure and temperature of the hydraulic fluid 300. The increased leakage varies the speed of the car 208. In case of up travel, i.e. a travel in the upward direction Up, the speed of the car 208 decreases whereas in down travel, i.e. a travel in the downward direction D, the speed of the car 208 increases. This again affects the ride-quality. In the present example of an up travel, the speed is lowered from 0.8 m/s under a pressure of 20 Bar in the elevator system with an empty car 208 to a speed of 0.75 m/s under a pressure of 40 Bar with a fully loaded car 208. The loss of levelling speed is even more drastic in that levelling speed of the empty car 208 is 0.07 m/s, whereas the levelling speed of the fully loaded car 208 is 0.03 m/s.

The loss of speed mentioned above is compensated and corrected by the control device and method according to the present invention as follows:

1. Through the output power converter 11, the computing module 6 reads and registers torque reference values during teaching (probe) runs of the car 208, once with an empty car 208 and may be the second time with a loaded car 208. This procedure may also be called torque capture. The reading is done when the output frequency at the output power converter 10 reaches the full speed reference frequency. The torque reading is obtained as a percentage of the available motor torque. For example, the measured torque reference of levelling speed travels for the empty car 208 is 50% and a 100% for the fully loaded car 208.

Figure 6:
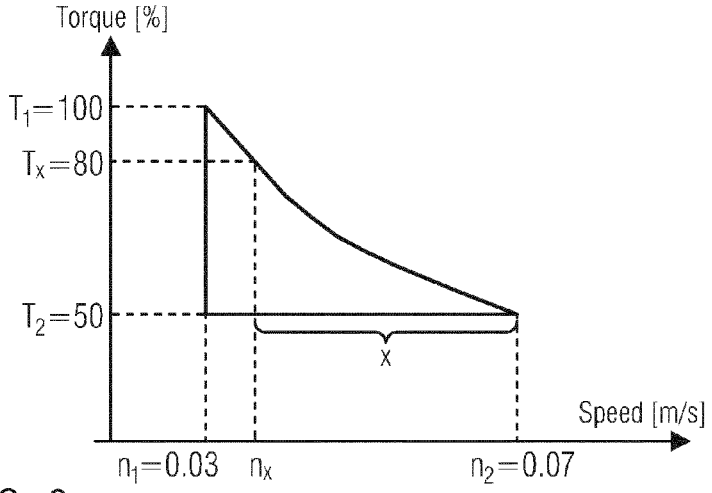
FIG. 6 shows a schematic diagram of an example giving an explanation for carload compensation in an example for a method according to the present invention.

2. Two new variables are then generated by the computing module 6 and then stored in the memory module 7 as $T_2$=50% and $T_1$=100%.
3. For the above torques, reference speed frequencies are supposed to be set in Hz as $f_{full}$ (p3-01)) for the full speed and $f_{level}$ (p3-04) for the levelling speed.
4. The actual speed of the car 208 may also be measured by a speed gauge or it may be calculated with a stop-watch during the probe runs. For example, an empty car 208 may have a levelling speed of 0.07 m/s and a loaded car have a speed of 0.03 m/s. Thus, a relationship may be generated in order to compute the levelling speed for a given (captured) torque reading, $T_x$. This is shown in FIG. 6, where for a captured torque of $T_x$=80%, the "x" may be calculated, which corresponds to a percentage drop in the levelling speed, i.e., $x/n_2$. Accordingly, the reference frequency of $f_{level}$ may be increased by a function of $x/n_2$ and a corrected speed of the car of 0.07 m/s would be obtained.
5. Then, the computing module 6 performs correction calculations for the full and levelling speeds, when the car 208 reaches the full speed frequency reference.
6. The inventive method allows for similar temperature compensation. However, for temperature compensation, it is necessary to utilize the temperature sensor 4.

Calculations and computing performed by the control device 1 and method according to the present invention are as follows:

Speed at the captured torque of $T_x$:

$$\eta_x = \eta_2 - \frac{\Delta\eta_i}{\Delta T_i} * (T_x - T_2)^{\gamma} \tag{1}$$

where, γ: a constant between 0.5 and 2, $T_x$: captured torque, $T_2$: reference torques.

$\Delta\eta_i$: difference in measured speeds, $\Delta T_i$: difference in measured torques.

Thus, $$\frac{x}{n2}:$$

Amount of speed loss in %, which can be simplified as:

$$\frac{x}{n_2} = Gain_{torque} * (T_x - T_2)^{\gamma} \tag{2}$$

$$\text{where, } Gain_{torque} = f(\Delta n_i, \Delta T_i^{\gamma}) \tag{3}$$

Thus, new reference speed frequency can be calculated as:

$$f_{level_{new}} = f_{level} * (1 + Gain_{torque} * (T_x - T_2 * I)^{\gamma}) \tag{4}$$

where, $$I = Gain3 * f(Temp_2, Temp_x) \tag{5}$$

I is a special function that accounts for the variation of system resistance to flow (pressure drop) as fluid temperature varies.

Here, $T_x$ is the captured torque during a probe run, which could be a full speed or levelling run. $T_2$ is the reference torque value that is different for full speed and levelling speed travels. $T_2$'s are obtained during the empty car probe run at a reference temperature $Temp_2$. $T_2$'s and $Temp_2$ remain unchanged in the formulations and $T_x$ and $Temp_x$ are read (captured) for each run to re-calculate the reference frequencies under the actual load and temperature condition.

Similarly temperature calculation can be derived as below;

$$f_{level_{new}} = f_{level} * (1 + Gain_{temp} * (Temp_x - Temp_2)^{\theta}) \tag{6}$$

where, θ: a constant between 0 and 2, $Temp_x$: captured fluid temperature, $Temp_2$: reference fluid temperature.

The resulting equation for both load and temperature compensation may be given by:

$$f_{j_{new}} = f_j + f_{level} * (Gain_{torque} * (T_{xj} - T_{2j} * I)^{\gamma} + Gain_{temp} (Temp_x - Temp_2)^{\theta}) \tag{7}$$

where, j indicates reference frequencies of full, secondary full, inspection or levelling speeds.

In these formulations only the initial speed frequency $f_j$ (i.e., $f_{full}$, $f_{ins}$, $f_{sec}$ etc) and reference frequency ($T_{2full}$, $T_{2ins}$, $T_{2sec}$, etc) are changed according to the digital speed (travel speed) input.

Figure 7:
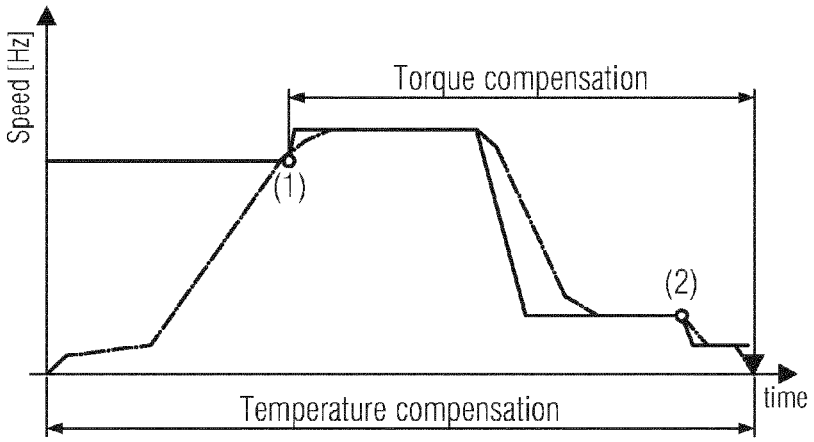
FIG. 7 shows a schematic diagram of the speed of a hydraulic pump in an elevator system applying torque compensation and temperature compensation over travel time according to an embodiment of a method according to the present invention.

FIG. 7 clarifies where to capture torques and in which regions to apply the compensations. Here, the reference frequency is plotted over travel time as a solid line. The output frequency is plotted over travel time as a dashed and a dotted line. The temperature compensation applies from the start to the end of the travel. The torque compensation starts with capturing the torque, $T_x$ at point (1). After capturing the torque and calculating the new frequency reference, torque compensation applies from point (1) to the end of the travel. The torque capture at point (2) is only performed during teach (probe) travels in order to establish a linear relationship between Torque and Speed. This linear relationship is used to derive reference torque values for intermediate car speeds such as, inspection and secondary full speeds.

Figure 8:
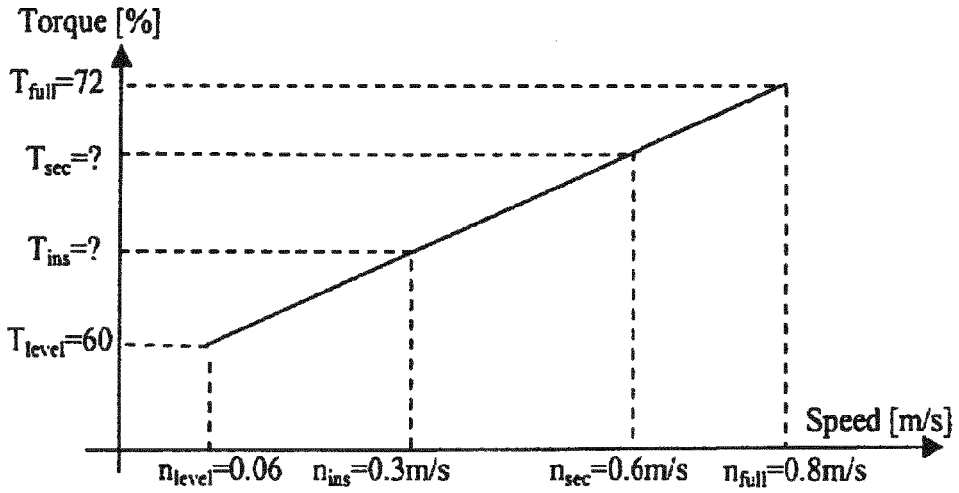
FIG. 8 shows a schematic diagram of an example of calculations of the torque of a motor running a hydraulic pump in an elevator system over the travelling speed of an elevator car for calculating inspection and secondary speed reference torque in line with an embodiment of a method according to the present invention.

FIG. 8 shows this calculation after an empty car probe travel. Here, during the probe run full and levelling speeds reference torques are captured. These are used to obtain inspection speed reference torque at 0.30 m/s and secondary full speed reference torque for example, at 0.6 m/s by using the following equation (8):

$$T_{2j} = T_{level} + \frac{T_{full} - T_{level}}{n_{full} - n_{level}} * (n_j - n_{level}) \tag{8}$$

Similarly, replacing torques in the equation (8) with reference frequencies may allow to calculate output reference frequencies [Hz] of inspection and secondary full speeds as follows:

$$f_{2j} = f_{level} + \frac{f_{full} - f_{level}}{n_{full} - n_{level}} * (n_j - n_{level}) \tag{9}$$

In order to be clear enough, following steps are applied to set system parameters:

1—Step 1: Input full, secondary full, inspection and levelling speeds (in m/s) in the inverter. Switch to teach mode. At teach mode no speed compensation is done (Gain multiplier is zero). 2—Step 2: Input pump performance data. After the confirmation of input data inverter reads the current temperature ($Temp_2$) and calculates full and levelling speed reference frequencies at empty and loaded car pressures. Apart from these values, leakages at empty and loaded car pressures, inspection and secondary speed reference frequencies and temperature gain ($Gain_{temp}$) are also calculated. Exemplary values are given below:

| | Full speed | Levelling speed | Leakage speed | Inspection speed | Secondary full speed |
|---|---|---|---|---|---|
| Empty car (20 bar) | 46.08 Hz | 7.66 Hz | 4.78 Hz | 29.66 Hz | 36.55 Hz |
| Loaded car (40 bar) | 49.86 Hz | 9.86 Hz | 6.86 Hz | No need | No need |
| $Gain_{temp}$ | | | 0.0326 | | |

After these calculations the temperature gain ($Gain_{temp}$) is saved and never changed again through calculations. Alternatively, the user is also able to input these values manually including the temperature gain.

Figure 9:
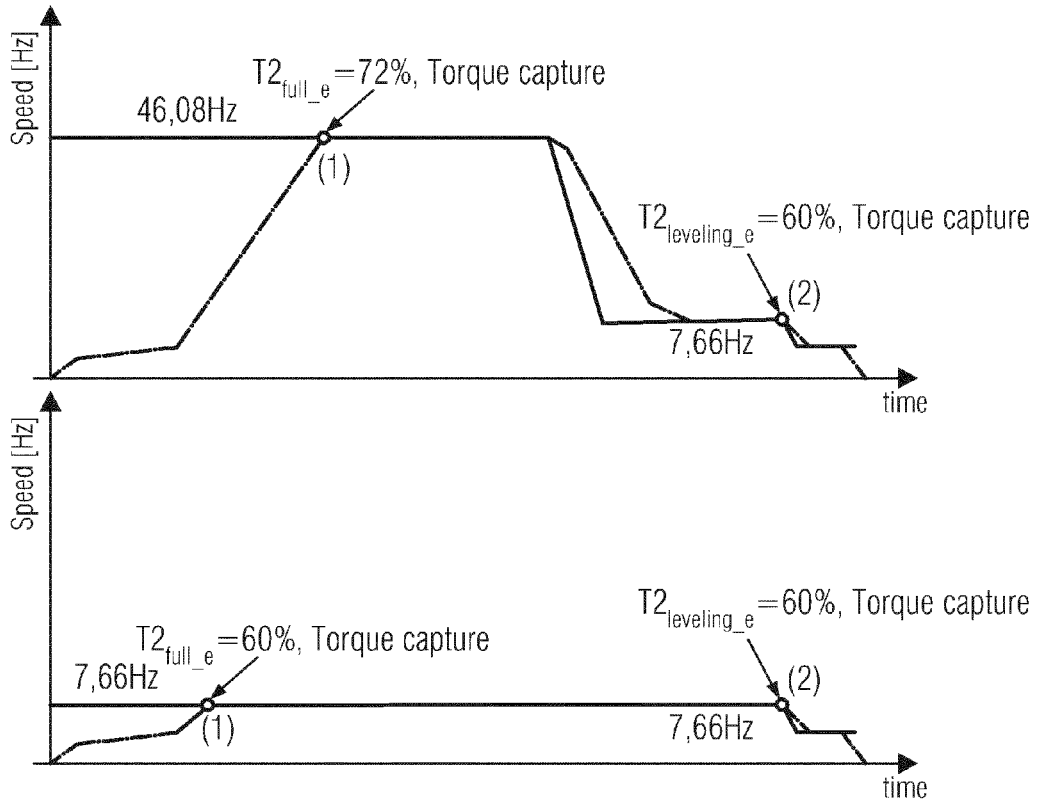
FIG. 9 shows two diagrams of respective examples for capturing torque references during respective teach runs of a car in a hydraulic elevator system, illustrated as speed of a hydraulic pump over travel time, especially for full speed and levelling speed.

3—Step 3: Set teach=1. While the car is empty perform a teach (probe) run. During the teach run Torque references and oil temperature are captured. $T2_{full_e}$ is the reference $T_2$ value when elevator makes a full speed travel whereas, $T2_{levelling_e}$ is the reference $T_2$ value when elevator travels only at levelling speed (Here a subscript e was added to remark empty car travel). At the end of the teach run Step 2 calculation is redone with the new $Temp_2$. Here, approximate torque gain ($Gain_{torque}$) and Gain3 are calculated or their default values may be is assigned. Captured torque references, $T2_{full_e}$ and $T2_{levelling_e}$ during each teach run are shown in FIG. 9.

Apart from at full speed, the car 208 can be run at only levelling (for re-levelling), at inspection and at secondary full speed. For each speed there is a different reference torque, $T_2$ (as seen from equation 7). During Step 3, torque references for full and levelling speeds were captured. The $T_2$ values and reference frequencies for the inspection and secondary full speed can be calculated by using equations (8) and (9).

Thus, a table such as below may be obtained for corresponding exemplary torque and speed references.

| Travel selection | Frequency reference [Hz] | T2, Torque reference [%] |
|---|---|---|
| Full speed | 46.08 | 72 |
| Only leveling speed | 7.66 | 60 |
| Inspection speed | 20.12 | 63.89 |
| Secondary full speed | 35.7 | 68.76 |

4—Step 4: If the speed of the car 208 is less than expected (due to lower pump performance), then the speed reference frequencies are increased manually and the teach run (at empty car pressure) is repeated until expected elevator speeds are obtained. During these teach runs Torque references and fluid temperature are re-captured. (At the end of each run new $Temp_2$ is read but no calculation is performed).

5—Step 5: In this step $Gain_{torque}$ is calculated precisely. The user either calculates the gain in Step 5 or uses the approximate value and manually adjust it. To perform the calculation:

Set Teach=2.

Increase levelling speed frequency 1.5 times.

Give levelling speed signal and run the elevator once empty and once loaded

During both runs observe the speed of the elevator and note them down together with captured torques Equation (3) is used to calculate $Gain_{torque}$ by using measured speeds and torque references.

6—Step 6: In this step Gain 3 is calculated. The user either calculates the gain in Step 6 or uses the default value and manually adjust it. To perform the calculation, Set Teach=3

Increase the oil temperature approximately 10 C by running the elevator continuously Repeat the empty teach run and record the captured torque and the oil temperature as $Temp_{10}$ and $T_{10}$. Then the torque values obtained at ambient fluid temperature and at elevated temperature (+10° C.) are placed in equations (4) and (5) to obtain Gain3.

Inverter Software

A computer program for operating a control device according to the present invention may have the following 6 sections:

1. Input parameters
   Motor tuning parameters (Standard)
   Pump data
2. Run mode selection
   Teaching mode
   Operation mode
3. Travel mode selection
   Constant Speed Mode
   Maximum Speed Mode
4. Intermediate speed settings
   Inspection & second full speed
5. Monitoring
   Temperature, Captured torques (full and levelling speeds)
6. Languages
   English, German, Turkish Possible Parameter Settings of the control device according to the present invention are as follows:

Firstly, initial settings are explained below:

1.1—Motor tuning parameters: the motor is tuned according to OLV for the chosen motor type.

1.2—Pump parameter setting:

The user should be able to obtain the necessary/approximate reference speed frequencies and compensation gains from the inverter 20 and/or the control device 1. In order to do that parameters listed below from a1 to a11 should be provided as input. If the user does not have the input data or if he wishes to change the calculated parameters, he should also be able to do so. Hence, a parameter calculation mode is to be initiated. As the user opens this mode and inputs necessary data then parameters will be calculated and assigned. When the inverter 20 and/or the control device 1 is not in the parameter calculation mode then the user may access the calculated parameters to modify them.

Parameter calculations are processed by the control device 1 in two steps:

In the first step, the reference temperature $Temp_2$ is captured automatically and input data from a1 to a11 are used to calculate all necessary parameters except $Gain_{torque}$ and Gain3. After the first step of calculations, the user is able to monitor the calculated parameters.

In the second step, $Gain_{torque}$ is calculated. In order to calculate $Gain_{torque}$, captured data of empty and loaded torques ($T_{2_e}$ and $T_{2_L}$) may be entered. This may be accomplished after obtaining the necessary parameters in the first step and later running the elevator at teaching mode once with empty car 208 and once with loaded car 208 at a reference temperature ($Temp_2$). During these runs the captured torques are assigned automatically together with the reference temperature.

The input data variables a1 to a11 and as well as corresponding explanations, i.e. definitions, and units are given in the table below. Firstly hydraulic oil parameters are (a1 and a2) input. Alternatively, oil parameters may be automatically assigned by selecting the oil type from a menu.

| Variable | Explanation | Unit |
|---|---|---|
| a1 | Temperature at 100 cSt | ° C. |
| a2 | Temperature at 25 cSt | ° C. |
| a3 | Flow at 100 cSt & at max pressure | lpm |
| a4 | Flow at 25 cSt & at max pressure | lpm |
| a5 | Nominal pump speed | rpm |
| a6 | Full speed flow rate | lpm |
| a7 | Levelling speed flow rate | lpm |
| a8 | Inspection speed flow rate | lpm |
| a9 | Secondary full speed flow rate | lpm |
| a10 | Flow at empty car pressure at 10OcSt | lpm |
| a11 | Flow at empty car pressure at 10OcSt | lpm |

Calculated reference frequencies and gains are given in the table below listing parameters P3-01 to P3-17 partly illustrated in FIG. 11, as well as their respective explanations, corresponding units and functional dependencies as functions f(x) of respective parameters $a_i$, wherein $_i$ corresponds to the number of variable names 1 to 11 above, and of $Gain_{temp}$, $T_{2_e}$, $T_{2_L}$, and $T_{10}$, respectively.

| Parameter | Explanation | Unit | f(x) |
|---|---|---|---|
| P3-01 | Full speed empty | Hz | $f(a_i, Gain_{temp})$ |
| P3-02 | Secondary full speed empty | Hz | $f(a_i, Gain_{temp})$ |
| P3-03 | Inspection full speed empty | Hz | $f(a_i, Gain_{temp})$ |
| P3-04 | Leveling speed empty | Hz | $f(a_i, Gain_{temp})$ |
| P3-05 | Full speed Loaded | Hz | $f(a_i, Gain_{temp})$ |
| P3-06 | Leveling speed loaded | Hz | $f(a_i, Gain_{temp})$ |
| P3-07 | Leakage speed empty | Hz | $f(a_i, Gain_{temp})$ |
| P3-08 | Leakage speed loaded | Hz | $f(a_i, Gain_{temp})$ |
| P3-09 | $Gain_{temp}$ = Temperature gain | — | $f(a_i)$ |
| P3-15 | $Gain_{torque}$ = Torque gain | — | $f(a_i, T_{2_e}, T_{2_L})$ |
| P3-17 | Gain3 | — | $f(T_2, T_{10})$ |

A selection of running modes of the control device 1 may be carried out as follows:

A. Teaching Mode

In order to obtain Reference Temperature and Reference Torque values ($T_2$ values) the elevator should run once empty and once loaded without any compensation (no torque and no temperature compensation). This is called teaching mode. To go into the teaching mode a multiplier (we name it as b1) of both gain values can be defined. Setting the multiplier (hi) to zero would cancel both compensations (torque and temperature). For example, for equation 7 it is shown below;

$$f_{j_{new}}=f_j+f_{level}*b1(Gain_{torque}*(T_{xj}-T_{2j}*I)^y+Gain_{temp}(Temp_x-Temp_2)^\theta)$$

During a single teaching run both torques for full speed and levelling speed may be captured. The teaching run is illustrated in FIG. 9.

In this mode, reference Torque values ($T_2$'s) for inspection and secondary full speed are also derived and assigned. During these runs following assignments are done;

1—Empty car run: Reference torques at Full and at levelling speeds, and reference temperature are captured. Inspection speed reference torque and secondary full speed reference torque are derived and assigned.

2—Loaded car run: Reference torque at full speed is captured, assigned and torque gain is calculated.

At the end of the teaching process the parameter b1 is set to 1.

B. Operation Mode

At operation mode the parameter b1=1. During each elevator run temperature and full speed torque are captured and used for compensations.

3—Travel Mode

There are two travel modes. These are Constant Speed Mode and Maximum Speed Mode (Energy saving mode).

3.1—Constant Speed Mode

Figure 10:
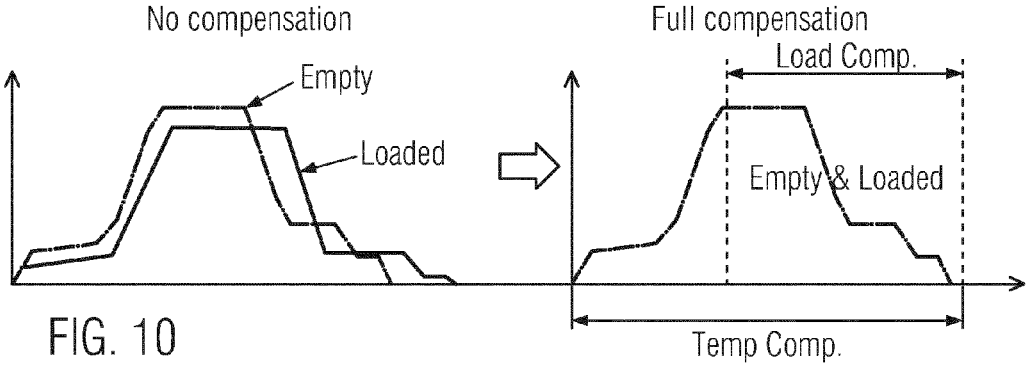
FIG. 10 shows two diagrams illustrating load and temperature compensation of the speed of a hydraulic pump over travel time in a hydraulic elevator system.

In this mode, the car 208 travels at constant full and levelling speeds regardless of load and temperature conditions. The control device 1 compensates motor rpm. Both torque (load) and temperature compensations are performed. This is done with the application of equations and finding the gain values. Load and temperature compensations are illustrated in FIG. 10.

Figure 11:
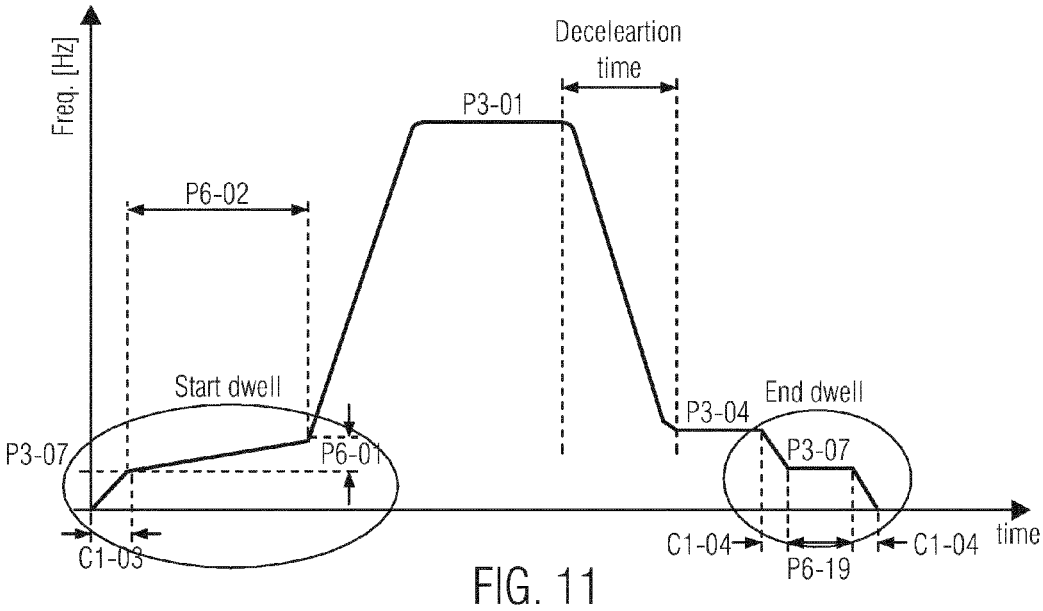
FIG. 11 shows a schematic diagram of an example for controlling pump speed in a hydraulic elevator system, especially additional requirements and functions used therein according to an embodiment of a method according to the present invention.

Special functions of the control device 1 are as follows:

Compensated Start Dwell Function:

As shown in FIG. 11, Compensated Start Dwell Function is defined with p6-01, p6-02, p3-07 and c1-03. p3-07 value is temperature compensated. p6-02 is for full speed, inspection and secondary full speed travels and p6-03 is only for levelling speed travel.

Compensated Stop Dwell Function:

It is defined with p3-07, p6-19 and c1-04. p3-07 value is fully (temperature & load) compensated. Additional requirements and functions are shown in FIG. 11.

Additional Requirements:

1—In order to have quick re-levelling of the car 208, p3-07 and p3-04 can be set to have higher values when the car 208 travels only at levelling speed.

2—In order to have smooth starts the time between two up-travels (travel interval) should be measured. If this time is too long start dwell time is then set higher.

3—Re-levelling duration limit: if re-levelling signal goes on longer than a pre-defined time inverter stops the motor and gives warning.

4—In order to have the same levelling duration (i.e., levelling run time) deceleration time is recalculated at every travel when maximum speed mode is used. In the constant speed mode, deceleration time is recalculated only when full travel speed is changed (for example full speed is changed to inspection or secondary full speed).

5—Lower and higher limits for temperature compensation is defined as percentages of the set speed frequency.

6—Lower and higher limits for load/torque compensation is defined as percentages of the set speed frequency.

7—When leakage of the pump is excessive in up travel or speed compensation is too high in down travel, the car 208 may not have positive speed in the direction of travel. Such an occurrence is captured by the control device 1 and a special procedure is run to assure the car to reach the floor level.

3.2. Maximum Speed Mode (Energy Saving Mode)

This mode behaves exactly same than the Constant speed mode.

Figure 12:
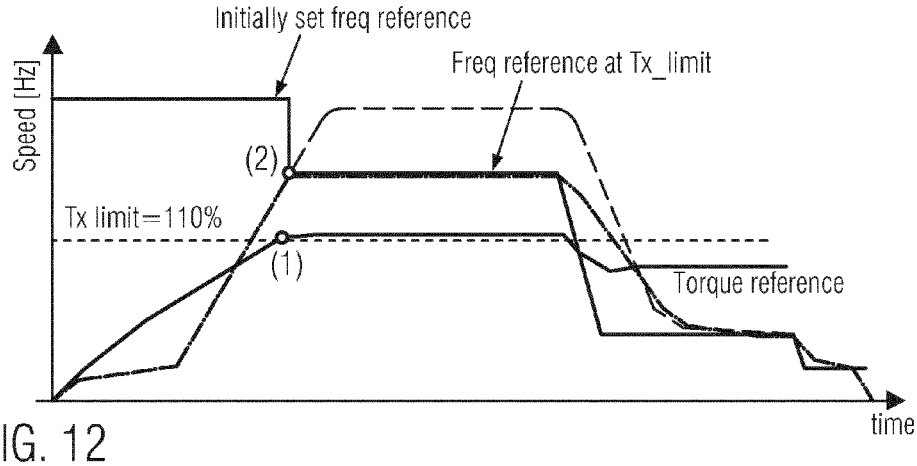
FIG. 12 shows a schematic diagram illustrating speed of a hydraulic pump over travel time of a car in a hydraulic system, especially for a travel in a maximum speed (energy saving) mode in line with an embodiment of a method according to the present invention.

In the max speed mode we define a torque reference limit Let's call it Tx_limit and assign it to a value that is close to the maximum motor torque, for example 110%. During acceleration, if torque reference becomes higher than $T_x$ limit (loaded car situation), then the output frequency at that moment is assigned to full speed frequency reference and the car 208 runs at full speed with this modified frequency reference. This is illustrated in FIG. 12, where the reference frequency is plotted over travel time as a dashed line and the output frequency is plotted over travel time as a solid line. At point (1), Torque ref is above Tx_limit. At point (2), Freq reference is changed.

In this mode, deceleration time should be changed accordingly in order not to have long levelling times. Max speed mode only applies to full and secondary full speeds. It is not applied to inspection speed.

The speed modes of the car 208 may be defined in the control device 1 as follows:

Full speed travel: The car 208 accelerates to full speed and decelerates to levelling speed before stopping.

Levelling speed travel or re-levelling: The car 208 accelerates to levelling speed and travels only at levelling speed until it stops.

Figure 13:
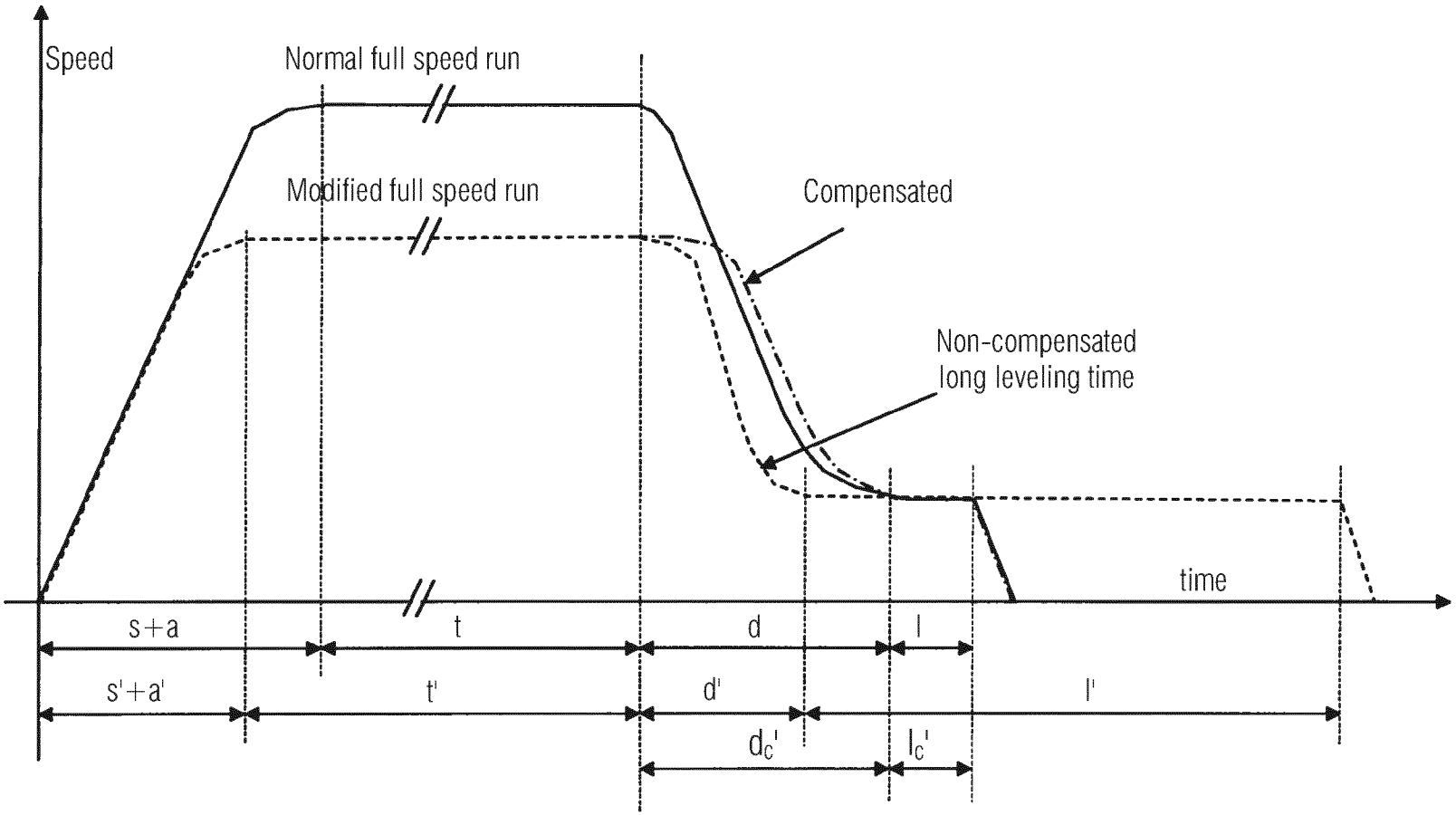
FIG. 13 shows an exemplary schematic illustration of diagrams representing the effect of car speed variation over travel time during a normal full-speed run and modified full-speed run.

FIG. 13 is an exemplary schematic illustration of diagrams showing the speed of the car 208 over travel time during a normal full-speed run and modified full-speed run. The normal full-speed run is illustrated by a solid line. The second full speed run is illustrated by a dashed line. Further, a compensated part of the modified full speed run is illustrated by a dashed and dotted line. As mentioned above in connection with FIG. 3, a normal full speed run may be divided into certain phases, that is the start phase s, the acceleration phase a, the travel phase t, the deceleration phase d, the levelling phase I and the stop phase h. For purposes of simplicity, the start and acceleration phase s, a are summarized in FIG. 13. The stop phase h is not explicitly dimensioned because it is assumed to be essentially equal during the normal full speed run and the modified full speed run for reasons of simplicity.

The modified full speed run may be divided into a modified start and acceleration phase s' and a', respectively, a travel phase t', a deceleration phase d', and a levelling phase I'. As can be seen, the maximum speed during the modified full speed run is smaller than the maximum during the normal full speed run. This may be due to a higher load of the car 208 and/or a higher temperature of the hydraulic fluid 300 during the modified full speed run in comparison to the normal full speed run. Also, the start and acceleration phase s' and a', respectively, during the modified full speed run are shorter than during the normal full speed run. The travel phase t' during the modified full speed run is longer than the travel phase t during the normal full speed run. Due to the lower maximum speed, the higher car load and/or a higher temperature of the hydraulic fluid during the modified full speed run in comparison with the normal full speed run, the modified deceleration phase d' is shorter than the deceleration phase d. However, the levelling phase-1' during the modified full speed run is significantly longer than the levelling phase I during the normal full speed run, since the car 208 has to decelerate from a lower speed (modified speed) in a shorter deceleration time d'. This longer levelling phase 1' significantly elongates the overall travel time, and thereby impedes ride quality.

In order to minimise the elongation of the overall travel time during the modified full speed run, the deceleration path is modified and the deceleration phase d' may be elongated in order to compensate partly for longer travel distance in the travel phase t' and also for the sharper deceleration from slower modified speed, such that a compensated deceleration time $d'_c$ become equal to the deceleration time d of the full speed run. During the compensated deceleration phase $d'_c$ of the modified full speed run, the car 208 may partly make up for travel distance during the travel phase t' in comparison with the travel phase t such that during the compensated modified full speed run, a levelling phase $I'_c$ may essentially become equal to the levelling phase I of the normal full speed run by changing the deceleration path of the modified speed run.

Figure 14:
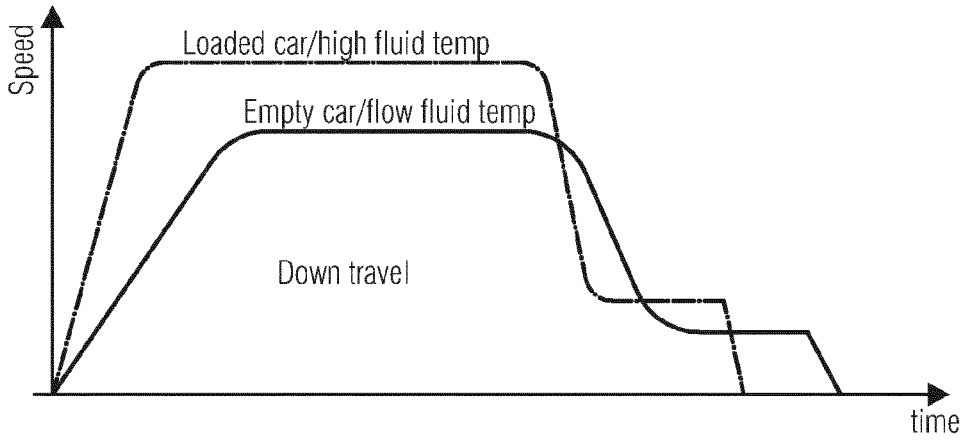
FIG. 14 shows a schematic illustration of diagrams representing the speed of a car over travel time down travels with a loaded car and high temperature of the hydraulic fluid as well as with an empty car and low temperature of the hydraulic fluid.

FIG. 14 shows a schematic illustration of two diagrams representing the speed of the car 208 over travel time during down travels with a loaded car 208 and high temperature of the hydraulic fluid 300 as a dashed and dotted line with an empty car 208 and low temperature of the hydraulic fluid 300 as a solid line, respectively. When inexpensive mechanical valves are used, in down travel, speed of the car 208 increases with increasing temperature and pressure of the hydraulic fluid 300 (the latter corresponding to the load of the car 208). This results in jerky starts with rapid acceleration and hard deceleration and jerky stop. The total travel time of the car 208 also changes due to varying maximum speed and duration of travel phases.

To prevent uncomfortable travel and improve ride quality, aforementioned method can be used to compensate variations in temperature of the hydraulic fluid 300 and load (the latter corresponding to the pressure of the hydraulic fluid 300) in the car 208. To provide smooth down travel with the use of an inverter according to the prior art, a special control valve, which increases the cost of the complete system, is required. In such a case, the motor should turn in reverse direction with the output frequency that is regulated by the inverter. At the same time, the control valve should have additional valves to provide smoother start and the inverter needs a braking resistor to burn out the generated energy that is produced during deceleration.

An inexpensive, simpler and easier way of controlling down travel ride quality according to an embodiment of the present invention, is to produce controlled upward flow in order to reduce downward excessive flow when the load of the car 208 and the temperature of the hydraulic fluid are excessive. This means, as the car 208 coming down with its own weight and pushing the hydraulic fluid 300 through the valve 104 into the tank, i.e. interior space 114 of the housing 113, the pump 102 can be used for giving upwards flow to decrease downward flow rate, i.e., the down speed of the car 208.

Figure 15:
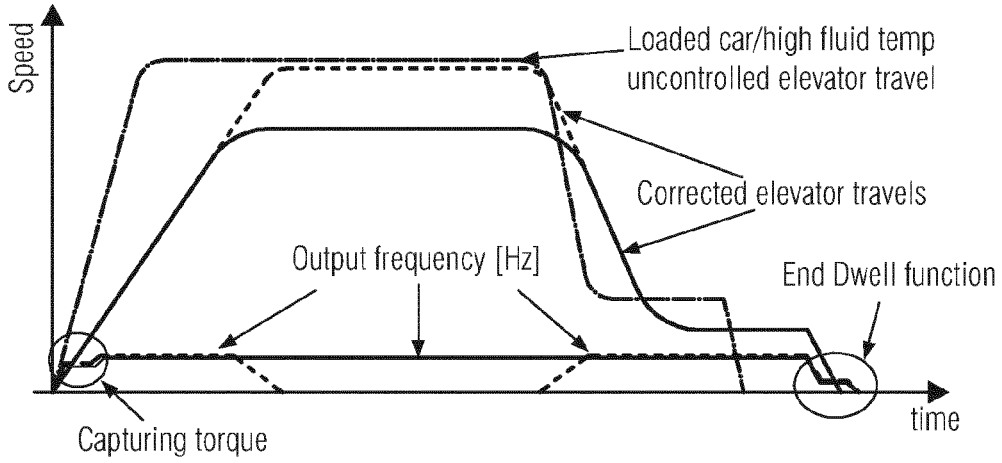
FIG. 15 shows a schematic illustration of diagrams representing the speed of a loaded car under high temperature of the hydraulic fluid, where load and temperature are compensated for by down travel speed control.

FIG. 15 shows a schematic illustration of diagrams representing the speed of a loaded car 208 under high temperature of the hydraulic fluid 300, where load and temperature are compensated for by down travel speed control according to an embodiment of the present invention. The compensations optionally can only be applied during the acceleration phase a and deceleration phase d, which is shown with dashed lines (Energy saving mode, Maximum speed mode), or during the complete travel, which is shown with solid lines (Constant speed mode).

At the beginning of down travel temperature compensation is applied. At a very initial stage the down acceleration torque ($T_{x_down}$) is captured. Depending on the difference in reference torque ($T2_{down}$) and $T_{x_down}$ ramps are determined together with ramp times (C1-01, C2-01, C2-03, etc.) to provide smooth acceleration, deceleration and constant speed. Here, the end dwell function is also provided to have smoother stop. In order to have short durations of the levelling phase, the deceleration time, i.e. length of the deceleration phase d, is re-calculated when maximum speed mode (Energy saving mode) is used.

Deviations from the above-described embodiments are possible within the inventive idea and without departing from the scope and effect of the present invention:

The control device may be designed, formed and adapted, as required according to the respective circumstances in order to be connected to the power line 2, the measuring line 3, the temperature sensor 4 as well as the supply line 5 in whatever numbers and forms required. All electrical lines shown and described herein, such as the power line 2, the measuring line 3, the supply line 5, the electrical lines 14, the control lines 210, the control line 214 as well as the control lines 216, 217 as well as the further control line 218 and the additional control line 219 may be formed, designed and specified as required for transmitting information and/or electrical power to and from each of the components to which they are connected to. However, it should be understood that especially in case of only information transmission, a line may also be replaced by appropriate wireless information exchanging technologies.

The computing module 6, memory module 7, monitoring module 8 and comparator module 9 may be connected as required for fulfilling the respective functions and exchange information via any form of digital or non-digital bus systems by using any appropriate algorithms to exchange information via the respective electrical lines 14. Thereby, the computing module 6, the memory module 7, the monitoring module 8 and the comparator module 9 may also communicate with the input power converter 10 and the output power converter 11.

The input power converter 10 and the output power converter 11 may be designed as AC/DC and DC/AC converters, respectively, and provided with any electric and electronic component which enable communication, transfer and conversion of electrical energy. The inverter 20 may comprise or be designed as the control device 1 which may comprise the computing module 6, the memory module 7, the monitoring module 8, the comparator module 9, the input power converter 10 and the output power converter 11 in any form and number required in order to meet the respective demands to control functions of the control device 1.

The control device 1 may be mounted in any appropriate interior space 12 provided by a box 13 with an enclosure portion 13*a* and a lid portion 13*b* in order to be easily handled, shipped, mounted and protected against harmful environmental influences such as moisture, dirt and harmful chemical substances which may damage the control device 1 or impede its functionality.

The hydraulic system 100 may be provided with as many electric motors 101, hydraulic pumps 102, ducts 103, hydraulic valves 104, ducts 105, strainers 106, heaters 107, damping elements 108, level indicators 109, cooler plugs 110, drain plugs 111, breather caps 112 as required for the respective application. The above mentioned components of the hydraulic system 100 may be mounted onto or within the housing 113 as required. The housing 113 may have a reservoir portion 113*a* and a lid portion 113*b* in any form and number required for providing an interior space 114 which may be formed as required for the functionality of the hydraulic system 100. Also gaskets 115 may be provided in any form and number required as to seal up the hydraulic system 100.

The elevator system 200 may comprise ducts 201, cylinders 202, piston rods 203, sheaves 204, horizontal axes 205, cables 206, stationary points 207, cars 208, control panels 209, control lines 210, main control devices 211, positioning elements 212, counter positioning elements 213, control lines 214, further control lines 215, control lines 216 and 217 as well as further control lines 218 and additional control lines 219 in any form and number required for moving a car in the upward direction Up and in the downward direction D. It is also possible that the sheave 204, the horizontal axis 205, the cable 206 and the stationary point 207 are omitted in order to place the cylinder 202 with the piston rod 203 below and/or above the car in order to directly drive the car 208 by the piston rod 203 which may be directly mounted to a bottom and/or top portion of the car 208. With the cable 206 connected to the car 208 in the exemplary manner shown herein by using one sheave 204 and one stationary point 207, a transmission ratio of 2:1 between the movement of the piston rod 203 and the car 208 is obtained. Alternatively, for implementing other transmission ratios, such as 1:1; 3:1; 4:1 etc. as well as fractions thereof, any desired number and combination of sheaves 204, cables 206, stationary points 207 and/or any other transmission gears as well as elements thereof may be used.

As a hydraulic fluid 300, any proper hydraulic fluid or oil may be utilized. As an energy source 400, any appropriate electrical energy source may be used.

References in the drawings may include:

| | |
|---|---|
| 1 | control device |
| 2 | power line |
| 3 | measuring line |
| 4 | temperature sensor |
| 5 | supply line |
| 6 | computing module |
| 7 | memory module |
| 8 | monitoring module |
| 9 | comparator module |
| 10 | input power converter |
| 11 | output power converter |
| 12 | interior space |
| 13 | box |
| 13a | enclosure portion |
| 13b | lid portion |
| 20 | inverter |
| 100 | hydraulic system |
| 101 | electric motor |
| 102 | hydraulic pump |
| 103 | duct |
| 103a | first duct portion |
| 103b | Silencer/pulsation damper |
| 103c | second duct portion |
| 104 | hydraulic valve |
| 105 | duct |
| 105a | first duct portion |
| 105b | diffuser |
| 106 | strainer |
| 107 | heater |
| 108 | clamping elements |
| 109 | level indicator |
| 110 | cooler plug |
| 111 | drain plug |
| 112 | breather cap |
| 113 | housing |
| 113a | reservoir portion |
| 113b | lid portion |
| 114 | interior space of housing |
| 115 | gasket |
| 200 | elevator system |

-continued

| | |
|---|---|
| 201 | duct |
| 202 | cylinder |
| 203 | piston rod |
| 204 | sheave |
| 205 | horizontal axis |
| 206 | cable |
| 206a | first section of cable |
| 206b | second section of cable |
| 207 | stationary point |
| 208 | car |
| 209 | control panel |
| 210 | control line |
| 211 | main control device |
| 212 | positioning element |
| 213 | counter positioning element |
| 214 | control line |
| 215 | further control panel |
| 216 | control line |
| 217 | control line |
| 218 | further control line |
| 219 | additional control line |
| 300 | hydraulic fluid |
| 400 | energy source |
| a | acceleration phase |
| d | deceleration phase |
| Down | downward direction |
| f | frequency |
| I | current |
| L | levelling phase |
| h | stop phase |
| S | speed of motor |
| s | start phase |
| t | travel phase |
| $Temp_x$ | captured temperature |
| $T_x$ | captured torque |
| Up | upward direction |
| U | voltage |
| s' | modified start phase |
| a' | modified acceleration phase |
| t' | modified travel phase |
| d' | modified deceleration phase |
| l' | modified levelling phase |
| h' | modified stop phase |
| $d'_c$ | compensated deceleration phase |
| $l'_c$ | compensated levelling phase |

The invention claimed is:

1. A hydraulic system control device comprising an inverter supplying a hydraulic pump of the hydraulic system with electric energy, wherein the inverter has an output variable that is adapted to adjust a speed of the hydraulic pump in order to at least partly compensate for a leakage of operating fluid in the hydraulic pump, and comprising a computing module which is adapted to determine the output variable based on at least one inverter parameter, wherein in operation, the output variable is adapted to effect a positive pump flow rate in both the upward and downward direction.

2. The control device according to claim 1, wherein the at least one inverter parameter comprises at least one of an output current, torque producing current, and internal torque reference value.

3. The control device according to claim 1, further comprising a monitoring module which is connected to a comparator module, which in response to operation of the control device, the monitoring module monitors the at least one inverter parameter and the comparator module compares the at least one monitored inverter parameter to at least one reference parameter.

4. The control device according to claim 3, wherein the at least one reference parameter comprises at least one of a reference frequency and a reference gain.

5. The control device according to claim 1, further comprising a memory module adapted to store and access at least one of a motor data, a pump data, a valve data and a hydraulic fluid data.

6. The control device according to claim 1, wherein the hydraulic pump is a part of an elevator system that starts and stops an elevator car, and the computing module is in communication with the hydraulic pump such that the output variable is adapted to cause the hydraulic pump to run with a leakage speed, wherein the leakage speed is a speed where a hydraulic pressure drop due to a pump leakage and/or a pressure drop inherent in the hydraulic system and/or the elevator-system is essentially equaled out.

7. The control device according to claim 6, wherein that the output variable is connected to lower the speed of the car in the elevator-system proportionally to an increase of the load of the car.

8. The control device according to claim 1, further comprising at least one measurement input for connecting a temperature sensor to the control device, in order to use at least one temperature parameter in determining the at least one output variable.

9. The control device according to claim 1, wherein during operation, the hydraulic pump is controlled by open loop control and/or V/f control.

10. The control device according to claim 1, wherein the control device is integrated into the inverter.

11. An elevator system comprising a hydraulic pump;

an inverter operable to supply a hydraulic pump of the hydraulic system with electric energy; and a control device which controls a supply of the hydraulic pump with electric energy from the inverter, wherein the control device is designed according to claim 1.

12. A method for controlling pressure in a hydraulic system comprising supplying a hydraulic pump of the hydraulic system with electric energy from an inverter;

controlling at least one output variable of the inverter; and adjusting the speed of the hydraulic pump by controlling the at least one output variable, in order to at least partly compensate for a leakage of operating fluid in the hydraulic pump, wherein the at least one output variable is determined as a function of at least one inverter parameter, wherein in operation, the at least one output variable is adapted to effect a positive pump flow rate in both the upward and downward direction.

13. The method according to claim 12, wherein the at least one inverter parameter is monitored and compared to at least one reference parameter.

14. The method according to claim 13, wherein the at least one reference parameter is obtained during at least one test run.

15. The method according to claim 12, wherein a leakage of the hydraulic pump and/or a pressure loss in the hydraulic system according to a respective load of at least one car of an elevator-system and/or a respective temperature of hydraulic fluid in the hydraulic system is at least partly compensated for during a full speed and/or a levelling speed of the car.

16. The method according to claim 12, wherein the length of the deceleration phase of the speed of the hydraulic pump is adjusted in order to keep the length of a levelling phase, where the hydraulic pump runs at a levelling speed, essentially constant under at least two different inverter parameters.

17. The method according to claim 12, wherein the positive flow rate of the hydraulic pump is generated for compensation of a speed of a car in the elevator system during a travel of the car in a downward direction.

18. The elevator-system according to claim 11, further comprising an elevator car, wherein the computing module is in communication with the hydraulic pump such that the output variable causes the hydraulic pump to run at a speed at which a hydraulic pressure drop due to a pump leakage is essentially equaled out allowing the control system to start and stop the elevator car.

19. The elevator-system according to claim 18, wherein that the output variable is adapted to lower the speed of the car in an elevator-system proportionally to an increase of the load of the car.

* * * * *